United States Patent [19]

Chevalier et al.

[11] Patent Number: 4,945,892

[45] Date of Patent: Aug. 7, 1990

[54] WATER HEATER WITH OUTER JACKET DAM

[75] Inventors: James L. Chevalier, Mequon; John D. Pfeffer, Brookfield; Leslie R. Wright, West Bend, all of Wis.

[73] Assignee: A.O. Smith Corporation, Skokie, Ill.

[21] Appl. No.: 293,682

[22] Filed: Jan. 5, 1989

[51] Int. Cl.[5] ..... A47J 27/00; F24H 7/00; B23H 1/00

[52] U.S. Cl. ..... 126/373; 220/68; 220/444; 220/445; 220/447

[58] Field of Search ..... 126/373; 220/444, 445, 220/447, 430, 431, 432, 433, 68, 70

[56] References Cited

U.S. PATENT DOCUMENTS

| | | | |
|---|---|---|---|
| 2,468,488 | 4/1949 | Coyle et al. | 220/68 X |
| 3,199,712 | 8/1965 | Nurkiewicz | 220/68 X |
| 3,253,731 | 5/1966 | Fink et al. . | |
| 4,372,028 | 2/1983 | Clark et al. . | |
| 4,447,377 | 5/1984 | Denton . | |
| 4,477,399 | 10/1984 | Tilton . | |
| 4,527,543 | 7/1985 | Denton . | |
| 4,628,184 | 12/1986 | West . | |
| 4,632,792 | 12/1986 | Clark . | |
| 4,736,509 | 4/1988 | Nelson . | |
| 4,744,488 | 5/1988 | Nelson . | |
| 4,749,532 | 6/1988 | Pfeffer . | |
| 4,790,290 | 12/1988 | Chevalier et al. . | |

*Primary Examiner*—Larry Jones

*Attorney, Agent, or Firm*—Andrus, Sceales, Starke & Sawall

[57] ABSTRACT

A water heater includes a lower skirt ring (10, 50) supporting and spacing an inner storage tank (2) above a support surface (10*a*), and an outer jacket (42, 54) spaced outwardly therefrom to define an annular cavity space (22) therebetween. The outer jacket is slid along the inner storage tank during assembly. A seal (46) on the inner surface of the outer jacket, preferably in the form of a rolled-in dimple, engages the inner storage tank and/or the lower skirt ring, either at a seal (44) or a flange (52), and forms a dam (48) during sliding of the outer jacket along the inner storage tank. The dam prevents leakage of liquid therepast during foaming insulation. The rolled-in dimple (56) may extend all the way through the annular space to engage the tank wall or skirt ring.

11 Claims, 2 Drawing Sheets

WATER HEATER WITH OUTER JACKET DAM

BACKGROUND AND SUMMARY

The invention relates to insulated fluid storage units, including hot water heaters.

Hot water heaters for domestic and other applications include an inner storage tank having an associated heating unit for heating water in the tank. The tank is enclosed with suitable insulation to retain the heat and minimize the necessity for frequent reheating. An outer aesthetically pleasing jacket or shell is provided to enclose the insulation.

A highly satisfactory insulating material is expandable foamed insulation such as expanding foamed polyurethane. The insulation is applied in a fluid state into the annular cavity space between the inner storage tank and the outer jacket and foams and expands to produce a rigid and closely adhering insulating enclosure about the inner tank.

Gas water heaters are provided with a burner aligned with the bottom of the storage tank. A skirt ring supports and spaces the tank above a support surface or base and defines a firing chamber. Polyurethane produces toxic fumes when burned, and hence must be protected from the temperature and flame of the heating unit. Various isolation sealing dams have been devised to deal with this problem, such as an inflatable donut bag, Clark et al U.S. Pat. No. 4,372,028, Tilton U.S. Pat. No. 4,477,399, a fiberglass collar, Pfeffer U.S. Pat. No. 4,749,532, Nelson U.S. Pat. No. 4,736,509, and an envelope bag, Denton U.S. Pat. Nos. 4,447,377, 4,527,543.

The present invention provides an improved dam which is simple and cost effective in manufacture.

BRIEF DESCRIPTION OF THE DRAWINGS

Prior Art

Present Invention

Figure 2:
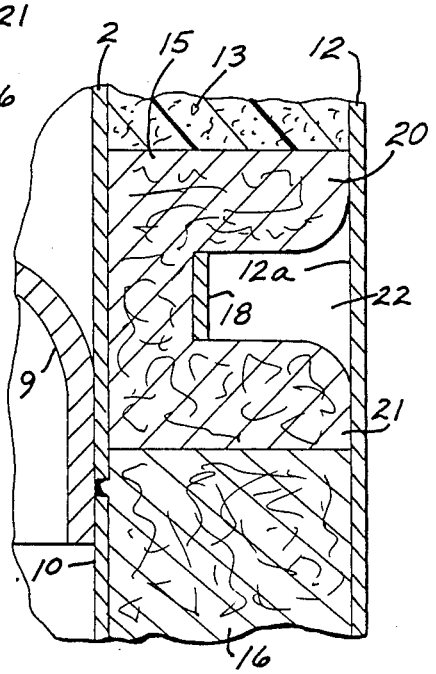
FIG. 2 PRIOR ART
FIG. 2 is an enlarged view of a portion of FIG. 1.
Figure 3:
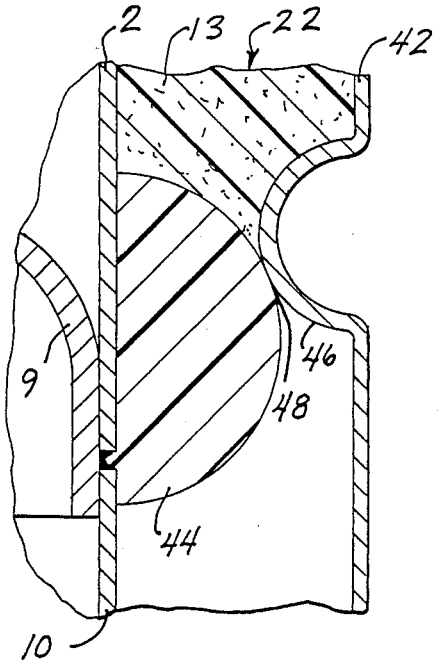

FIG. 3 is a view like FIG. 2 and shows the present invention.

Figure 4:
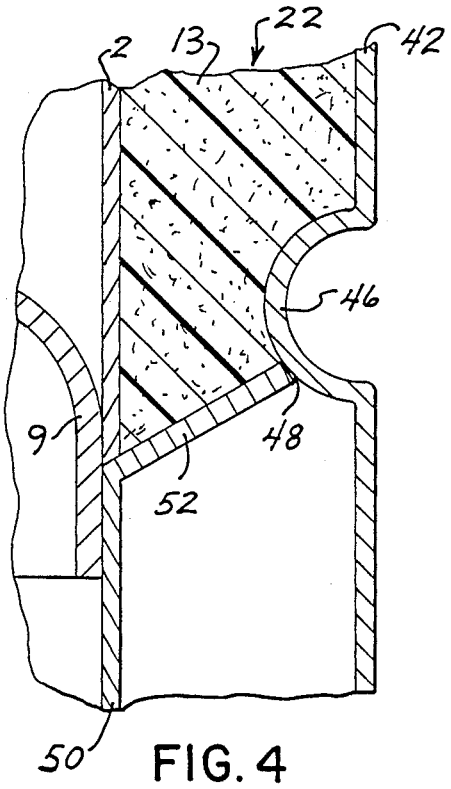

FIG. 4 is a view like FIG. 3 and shows an alternate embodiment.

Figure 5:
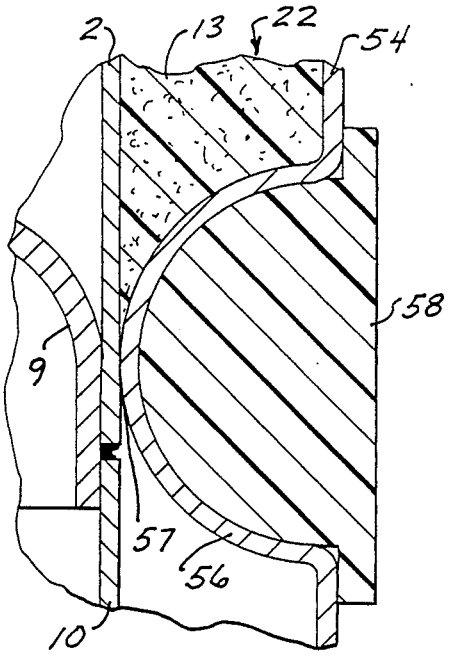

FIG. 5 is a view like FIG. 4 and shows an alternate embodiment.

DETAILED DESCRIPTION

Prior Art

Figure 1:
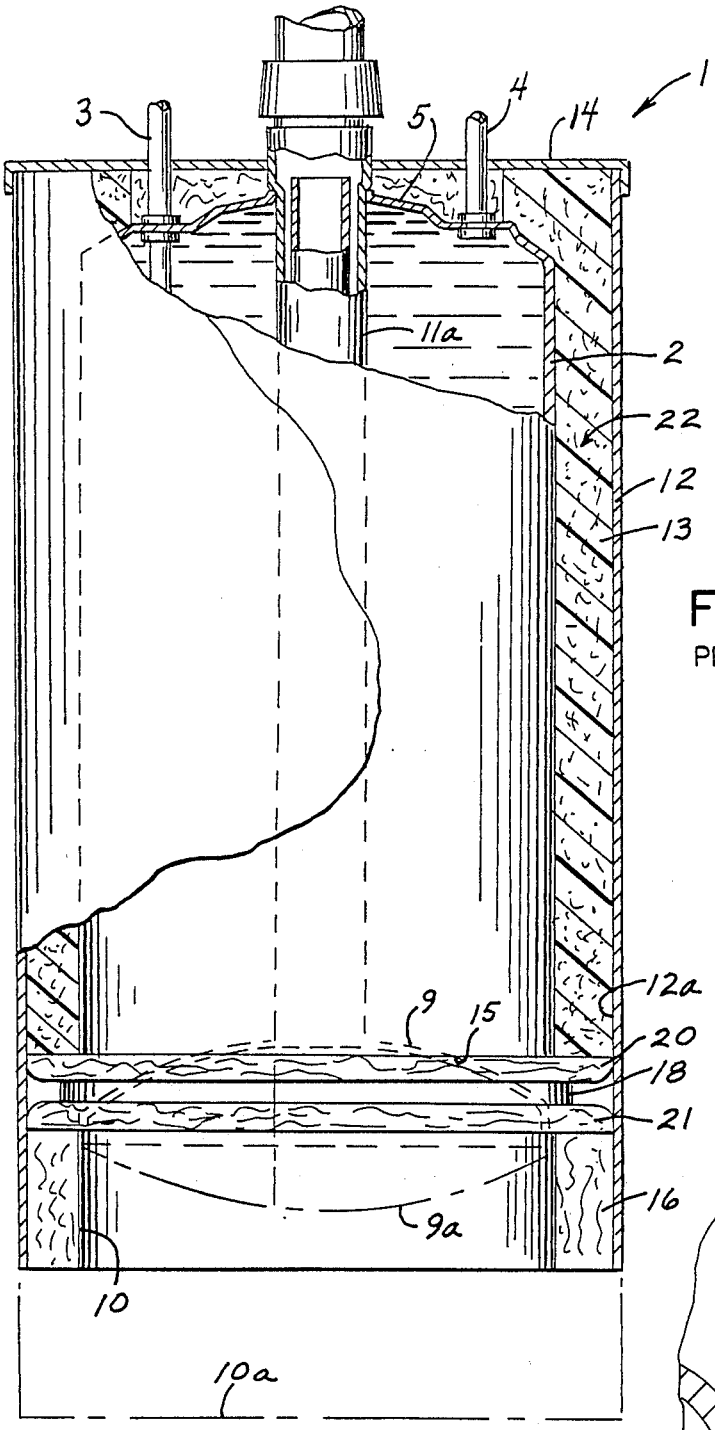
FIG. 1 PRIOR ART
FIG. 1 is a side elevation view of a hot water heater, partially broken away, known in the prior art.

FIGS. 1 and 2 show a hot water heater 1 known in the prior art, for example as shown in Pfeffer U.S. Pat. No. 4,749,532, incorporated herein by reference. FIGS. 1 and 2 use like reference numerals from the incorporated Pfeffer patent where appropriate to facilitate clarity. Inner steel storage tank 2 has water inlet and outlet connections 3 and 4 at domed top wall 5. Tank 2 may have a concave bottom wall as shown in dashed line at 9, and as shown in the incorporated Pfeffer patent, or may have a convex bottom wall as shown in dashed line at 9*a*. Lower annular steel skirt ring 10 is welded to tank 2 supports and spaces tank 2 above a support surface or base shown in dashed line at 10*a*. The full vertical height of skirt ring 10 is not shown, and will vary depending upon application. Skirt ring 10 defines a fire box or chamber within which is mounted the heater unit, for example as shown at 11 in FIG. 2 of the incorporated Pfeffer patent. Skirt ring 10 may rest directly on the floor and have cut-outs therein to supply combustion air to the fire box chamber, or the support surface or base 10*a* may have cut-outs therein and be supported above the floor by legs (not shown). Flue duct 11*a* is mounted centrally of tank 2 and extends upwardly beyond top tank wall 5 for exhausting waste gases of combustion. The inner surface of tank 2, as well as the outer surface of flue 11*a*, can be coated with a conventional corrosion resistant coating (not shown) such as glass or vitreous enamel.

An outer aesthetically pleasing jacket or shell 12 formed of relatively thin metal is spaced outwardly of inner tank 2 to define an annular cavity space 22 therebetween. Foamed insulation 13 is introduced as a liquid into annular space 22 and hardens to form an annular insulation layer around inner storage tank 2, for which further reference may be had to the incorporated Pfeffer patent, including FIG. 7 thereof. Insulation 13 extends upwardly over top wall 5 of tank 2. A jacket cover 14 is secured to the top of jacket 12 and maintains an aesthetically pleasing outer enclosure and defines an upper space which is filled with insulation 13. The lower end of insulation 13 is defined by an encircling fiberglass belt 15 providing a dam blocking passage of liquid therepast during the foaming insulation process. The dam isolates insulation 13 from the heater unit below the tank. Belt 15 is wrapped around the tank and held thereto by an encircling cinch band 18 tightened to cause the upper and lower ends 20 and 21 of belt 15 to bulge or flare outwardly to fill the gap to the inner wall 12*a* of outer jacket 12, to provide the noted dam. Another fiberglass belt 16 may encircle skirt ring 10 below belt 15, for further insulation.

Present Invention

FIG. 3 illustrates the present invention and uses like reference numerals from FIGS. 1 and 2 where appropriate to facilitate clarity. Lower skirt ring 10 supports and spaces inner storage tank 2 above support surface 10*a*, as in FIG. 1. Outer jacket 42 is around inner storage tank 2 and spaced outwardly therefrom to define annular cavity space 22 therebetween. During assembly, outer jacket 42 is slid downwardly along inner storage tank 2. A first seal 44 is formed on the outer surface of inner storage tank 2 and/or skirt ring 10. Seal 44 may be a band of fiberglass material, rubber, preformed polyurethane, or any other suitable material. A second seal 46 is formed on the inner surface of outer jacket 42. In preferred form, seal 46 is a rolled-in dimple in the outer jacket forming an annulus extending inwardly into annular space 22, though other forms of seals may be provided on the inner surface of outer jacket 42, for example a ring or band of sealing material such as fiberglass, rubber, preformed polyurethane, etc. Seals 44 and 46 contact each other and form a dam at engagement point 48 during sliding of outer jacket 42 along inner storage tank 2. Dam 48 seals annular space 22. Foamed insulation introduced as a liquid into annular space 22, FIG. 7 of the incorporated Pfeffer patent, hardens to form an annular insulation layer 13 around inner storage tank 2. Dam 48 prevents leakage of the liquid therepast.

In FIG. 4, lower skirt ring 10 is modified to provide a skirt ring 50 with an upper integral flange 52 extending radially outwardly and upwardly to engage rolled-in dimple 46 and form dam 48. Alternatively, the flange could extend from tank 2.

In FIG. 5, outer jacket 54 has a rolled-in dimple 56 replacing dimple 46 and providing a seal on the inner surface of the outer jacket extending inwardly all the way through annular space 22 and engaging inner storage tank 2 and/or skirt ring 10 at point 57 to form the noted dam. An external annular cover 58 extends around outer jacket 54 and fills dimple 56.

It is recognized that various equivalents, alternatives and modifications are possible within the scope of the appended claims.

What is claimed is:

1. An insulated fluid storage unit an inner storage tank;

a lower skirt ring supporting and spacing said inner storage tank above a support surface;

an outer jacket around said inner storage tank and spaced outwardly therefrom to define an annular space therebetween, said outer jacket being slid along said inner storage tank;

first sealing means on the outer surface of at least one of said inner storage tank and said skirt ring;

second sealing means on the inner surface of said outer jacket, said first and second sealing means contacting each other and forming a dam at the interface thereof during said sliding of said outer jacket along said inner storage tank, said dam sealing said annular space;

foamed insulation introduced as a liquid into said annular space and contacting both of said first and second sealing means at said interface thereof and hardening to form an annular insulation layer around said inner storage tank, said dam preventing leakage of said liquid therepast.

2. The invention according to claim 1 wherein said second sealing means comprises a rolled-in dimple in said outer jacket forming an annulus extending inwardly into said annular space and engaging said first sealing means to form said dam.

3. The invention according to claim 1 wherein said first sealing means comprises sealing material on the outer wall of said inner storage tank.

4. The invention according to claim 1 wherein said first sealing means comprises a flange extending radially outwardly from one of said inner storage tank and said skirt ring and engaging said second sealing means.

5. The invention according to claim 4 wherein said flange extends radially outwardly from said skirt ring.

6. The invention according to claim 5 wherein said second sealing means comprises a rolled-in dimple in said outer jacket forming an annulus extending inwardly into said annular space and engaging said flange of said skirt ring to form said dam.

7. An insulated fluid storage unit comprising:

an inner storage tank;

a lower skirt ring supporting and spacing said inner storage tank above a support surface;

an outer jacket around said inner storage tank and spaced outwardly therefrom to define an annular space therebetween;

sealing means on the inner surface of said outer jacket engaging at least one of said inner storage tank and said skirt ring as said outer jacket is slid along said inner storage tank to form a dam sealing said annular space;

wherein said skirt ring has an annular flange extending radially outward therefrom and engaging said sealing means;

foamed insulation introduced as a liquid into said annular space and hardening to form an annular insulation layer around said inner storage tank, said dam preventing leakage of said liquid therepast.

8. The invention according to claim 7 wherein said sealing means on the inner surface of said outer jacket comprises a rolled-in dimple in said outer jacket forming an annulus extending inwardly into said annular space.

9. The invention according to claim 8 wherein said dimple extends all the way through said annular space.

10. The invention according to claim 9 wherein said dimple engages said inner storage tank to form said dam.

11. The invention according to claim 8 comprising an external annular cover extending around said outer jacket and filling said dimple.

* * * * *